US009301611B2

(12) United States Patent
Lafer

(10) Patent No.: US 9,301,611 B2
(45) Date of Patent: Apr. 5, 2016

(54) LEG AND FOOT SUPPORT STRUCTURE TO BE APPLIED TO TILTABLE ARMCHAIRS

(76) Inventor: Percival Lafer, São Paulo (BR)

( * ) Notice: Subject to any disclaimer, the term of this patent is extended or adjusted under 35 U.S.C. 154(b) by 483 days.

(21) Appl. No.: 13/516,215

(22) PCT Filed: Nov. 30, 2010

(86) PCT No.: PCT/BR2010/000403
§ 371 (c)(1),
(2), (4) Date: Jun. 14, 2012

(87) PCT Pub. No.: WO2011/072350
PCT Pub. Date: Jun. 23, 2011

(65) Prior Publication Data
US 2012/0267921 A1 Oct. 25, 2012

(30) Foreign Application Priority Data
Dec. 18, 2009 (BR) ..... 0909677

(51) Int. Cl.
*A47C 1/02* (2006.01)
*A47C 1/034* (2006.01)
*A47C 7/00* (2006.01)

(52) U.S. Cl.
CPC ..... *A47C 1/034* (2013.01); *A47C 7/002* (2013.01)

(58) Field of Classification Search
CPC ..... A47C 1/023; A47C 1/029; A47C 1/034; A47C 1/0345; A47C 1/0355
USPC ..... 297/84, 68, 87
See application file for complete search history.

(56) References Cited

U.S. PATENT DOCUMENTS

| | | | | | |
|---|---|---|---|---|---|
| 3,295,885 | A * | 1/1967 | Barksdale | 297/84 |
| 4,364,603 | A * | 12/1982 | Johnson | 297/84 |
| 4,506,925 | A * | 3/1985 | Crum | 297/69 |
| 5,000,510 | A * | 3/1991 | Lafer | 297/84 |
| 6,659,556 | B2 * | 12/2003 | Pellerin | 297/330 |
| 6,692,078 | B2 * | 2/2004 | Pham et al. | 297/423.2 |
| 8,746,802 | B1 * | 6/2014 | Delmestri | 297/423.19 |
| 2003/0080597 | A1 * | 5/2003 | Beroth et al. | 297/330 |

FOREIGN PATENT DOCUMENTS

| | | | | |
|---|---|---|---|---|
| DE | 3725462 A1 * | 2/1989 | | A47C 1/037 |
| EP | 0218502 * | 4/1987 | | A47C 1/042 |
| EP | 0218502 A1 | 4/1987 | | |
| WO | WO 9637130 A1 * | 11/1996 | | A47C 7/50 |

* cited by examiner

*Primary Examiner* — Laurie K Cranmer
(74) *Attorney, Agent, or Firm* — Arent Fox LLP

(57) ABSTRACT

A leg and foot support structure applied to tiltable armchairs, comprised of a quadrangular rigid structure, said quadrangular rigid structure being lifted by means of feet; a pivotable quadrangular articulated frame for supporting the feet that is assembled on the front half and within said rigid structure; moving parts of said structure being operated by driving assemblies comprised of articulated arms connected and actuated simultaneously by a driving unit. An inner sliding frame composed of two quadrangular structures that slide over each other through articulated arms pivoted to the respective structures and to a rigid articulated frame that is angularly moved in order to be underneath a seat structure; said quadrangular structures start their relative slippage only after the articulated rigid frame reaches an end of its angular displacement.

8 Claims, 10 Drawing Sheets

LEG AND FOOT SUPPORT STRUCTURE TO BE APPLIED TO TILTABLE ARMCHAIRS

CROSS-REFERENCE TO RELATED APPLICATIONS

This application is the National Stage entry of international application No. PCT/BR2010/000403, filed Nov. 30, 2010, and claims the priority of Brazil Application No. PI 0909677-9, filed Dec. 18, 2009, the entire specifications, claims and drawings of which are incorporated herein by reference.

BACKGROUND

1. Field

The present invention is directed to an improved leg and foot support structure to be applied to tiltable armchairs.

2. Introduction

Many different types and models of armchairs that are comprised of articulated structures provided with driving mechanisms for the seat, backrest and leg and foot support are already known and widely used. Generally, such mechanisms are operated by mechanical locks that, once released, provide the pivoting movement that change the initial position of the assembly into reclined positions and rotate the front of the furniture which is then turned into a support for the feet.

This conventional construction results in a first initial position, wherein the seat and backrest are in a normal sitting position and the leg and foot support is constricted. In a second position, the seat and backrest move forward and tilt, and the seat front rotates upward, thus forming the feet support. In some cases, there is a third position, wherein the backrest tilts a little longer so that a more relaxed position is attained.

In spite of being widely used, the tiltable armchair assemblies provided with such types of conventional mechanisms present a number of limitations and inconveniences in a more specific way and with respect to the feet support mechanism, as follows:

a) aesthetics: some conventional mechanisms are based on the use of the front of the seat as a support for the feet whenever it is struck upward. In order to use the extension of such surfaces as a support for the feet, such armchairs must have their front—and consequently their sides and back—extended to the ground, otherwise the surface designed for supporting the feet will not suffice. This solution prevents such armchairs from having a spacing below the seat line, which is the current trend in the armchairs designed nowadays. The consequence is that these armchairs are not elegant, besides the fact that the double function thereof is clearly shown, thus hindering its use in an environment where the contemporary design is the preponderant factor when choosing the furniture.

b) ergonomics: the armchairs with such conventional mechanisms are greatly limited, therefore it may not be possible to attain a suitable ergonomic solution, that is, the physical limitation for a suitable length of the feet support.

c) visually and functionally: the conventional mechanisms are based on the use of the front of the seat as a support for the feet, when it is struck upward. The surface designed for supporting the feet is then fixed and sometimes insufficient depending on the height of the user. The conventional solution prevents the seat of such armchairs from being low, which is also a current trend in the armchairs designed nowadays.

SUMMARY

One of the objects of the present invention is to provide an improved leg and foot support structure applied to tiltable armchairs where they are practically and effectively actuated and handled.

Another object of the present invention is to provide an improved leg and foot support structure applied to tiltable armchairs that may provide a minimum spacing between the ground and the base of the armchair or sofa seat, thus providing the designer with a great freedom to create same. The object is to make it possible to create modern light designs that do not show the multiple functions of the furniture when it is in the closed position.

Another object of the present invention is to provide an improved leg and foot support structure applied to tiltable armchairs that is kept constricted under the seat when inoperative and that is struck forward when in an operative position, thus attaining a bigger extension than the one usually attained, so that it may be used by taller people.

Another object of the present invention is to provide an improved leg and foot support structure applied to tiltable armchairs of a simple construction concerning the parts that make out the support and driving system of the armchair and makes it possible to use different types of base for supporting the armchair.

Another object of the present invention is to provide an improved leg and foot support structure applied to tiltable armchairs that is structurally portable without requiring complementary structures, and that is provided with a reduced number of moving parts, thus reducing the whole weight of the assembly.

Another object of the present invention is to provide an improved leg and foot support structure applied to tiltable armchairs that makes it possible to position the support for the feet in several different heights.

These and other objects and advantages of the present invention are realized by an improved leg and foot support structure applied to tiltable armchairs of the type comprised of a quadrangular rigid basic structure that comprises side beams that are transversally and longitudinally connected to one another by front and back crossbars, said quadrangular rigid basic structure being horizontally lifted off the ground by means of base feet that provide an apparent spacing between the ground and the horizontal base of the armchair; an articulated quadrangular frame previously provided with a second inner sliding frame that defines a pivotable feet support assembly that is assembled on the front half inside said basic rigid structure; all the moving parts that make out said structure being operated by specific driving assemblies comprised of articulated arms that are connected and actuated simultaneously by a driving unit. According to the present invention, the improvement is based on the provision of a system having articulated arms connected to a sliding structure that are sized in such a way that it is possible to reduce the height of the seat without hampering the final length of the support whenener it is extended; the provision of a supplemental articulated structure that promotes a bigger extension of the support for the feet, starting from the sliding structure, that is replaced by another one that is comprised of two rails instead of one, said second rail housing a system of articulated arms that actuate the second structure from the time the system moves beyond a threshold point in relation to the ground and starts to advance in relation to the first structure.

Still another object and advantage of the present invention consist of an improved leg and foot support structure applied to tiltable armchairs that makes it possible to change the angle of the seat when the armchair moves from an initial position, without an extended support, to a tilted position. It comprises a small structure that is connected to the seat of the armchair and is interconnected to the feet support system through a pivoting arm that is connected to the handle that actuates the feet support. When the handle is rotated to extend the support, the pivoting arm rotates therewith, thus lowering the seat.

It is understood that other aspects of the invention will become readily apparent to those skilled in the art from the following detailed description, wherein various aspects of the present invention are shown and described by way of illustration only. As will be understood, the present invention is capable of other and different variations and its several details are capable of modification in various other respects, all without departing from the scope of the invention. Accordingly, the drawings and detailed description are to be regarded as illustrative in nature and not as restrictive.

DETAILED DESCRIPTION

Figure 1:
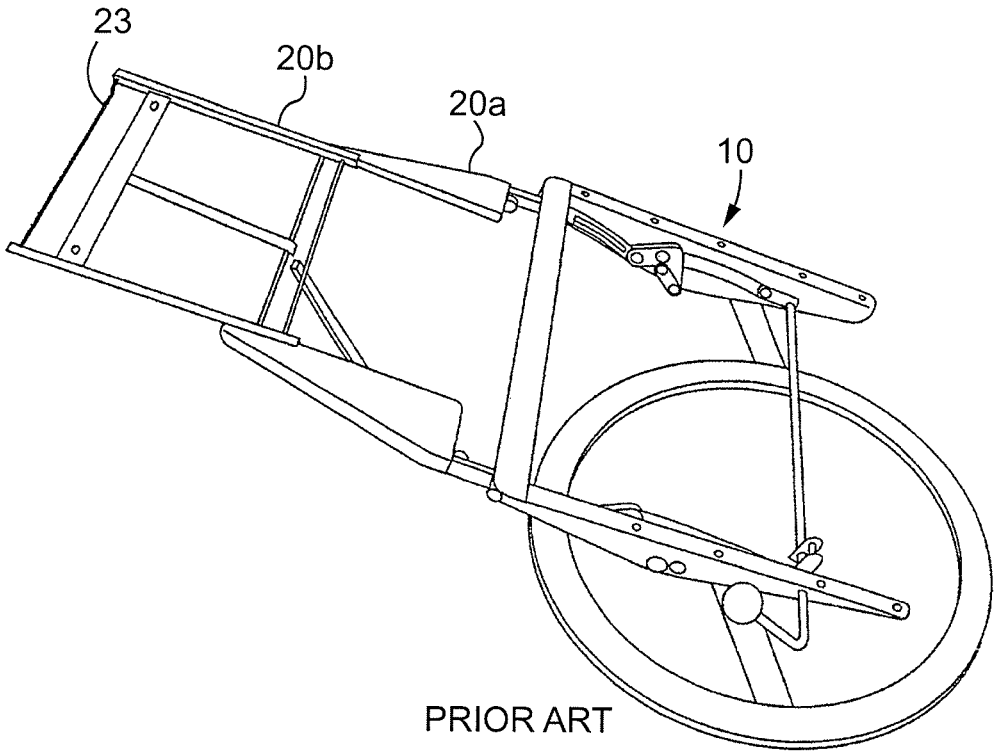
PRIOR ART FIG. 1
FIG. 1 depicts a perspective view of a leg and foot support structure conventionally known, shown in its fully extended position, and with a supporting base, ready to be assembled under the seat of a reclining armchair.
Figure 2:
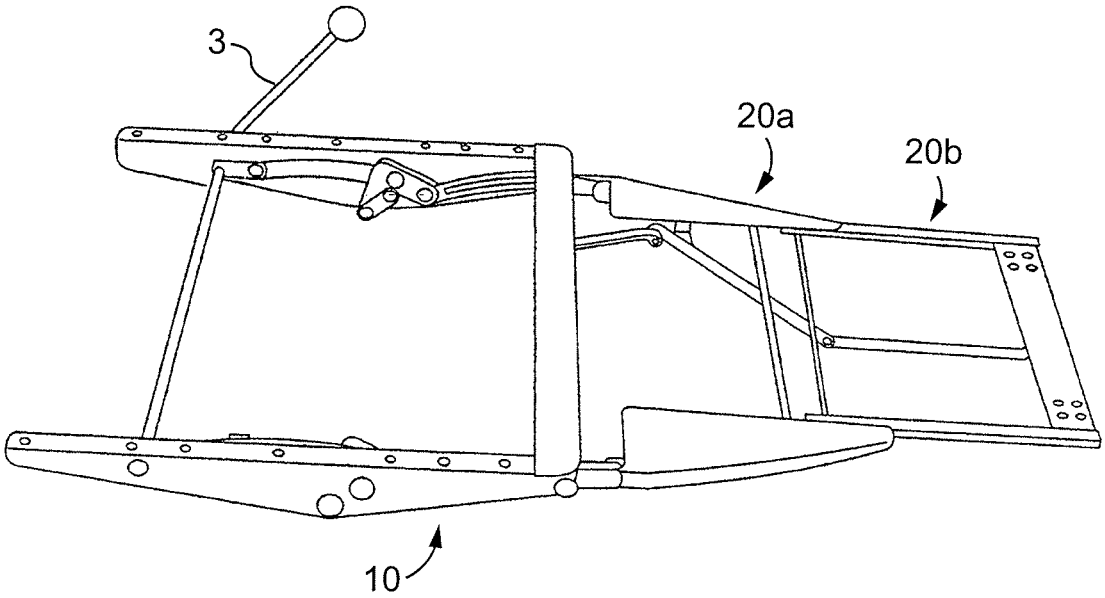
PRIOR ART FIG. 2
FIG. 2 depicts another perspective view of a leg and foot support structure conventionally known, shown in its fully extended position, to be assembled under the seat of a reclining armchair.
Figure 3:
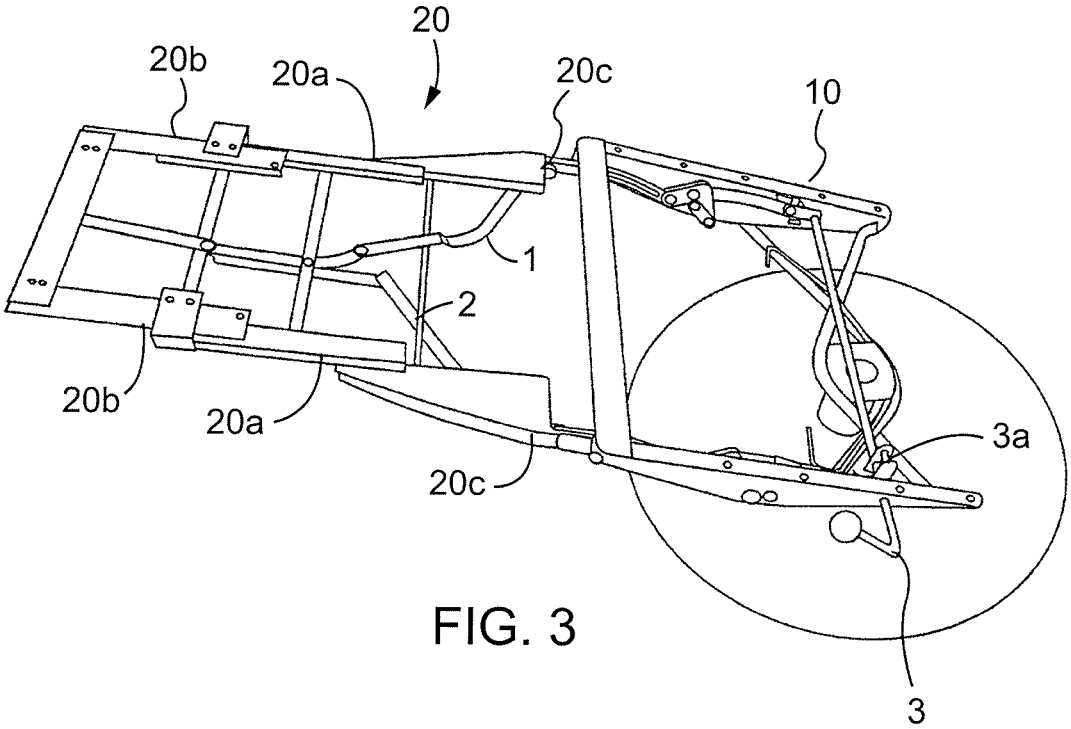
FIG. 3 depicts a perspective view of the improved leg and foot support structure to be applied to reclining armchairs, said structure being shown in its fully extended position, and connected to a support base.
Figure 4:
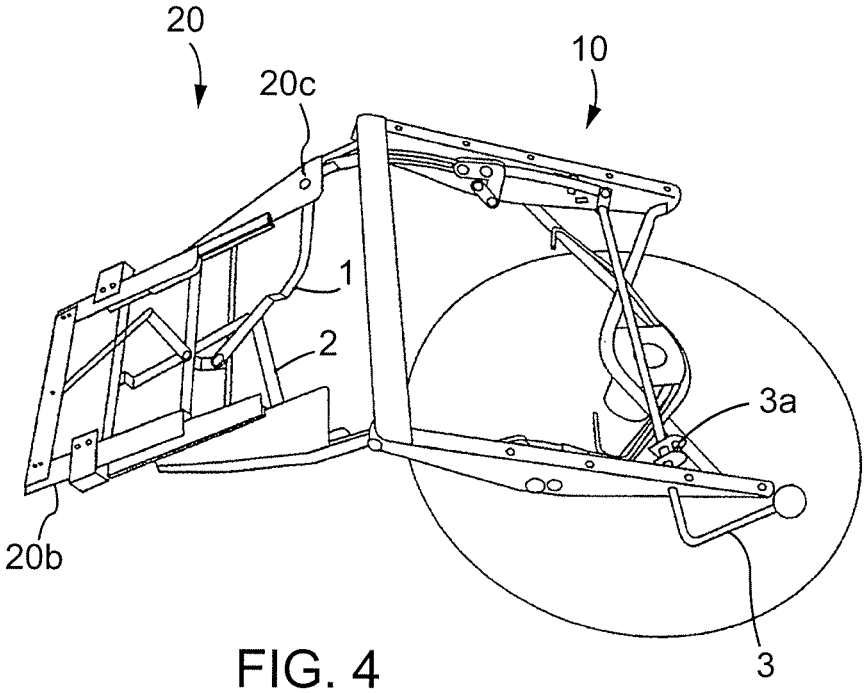
FIGS. 4,5, and 6, depicts the same perspective view of the improved leg and foot support, to be applied to reclining armchairs, said structure being shown in different views of partial constriction, and connected to a support base.
Figure 5:
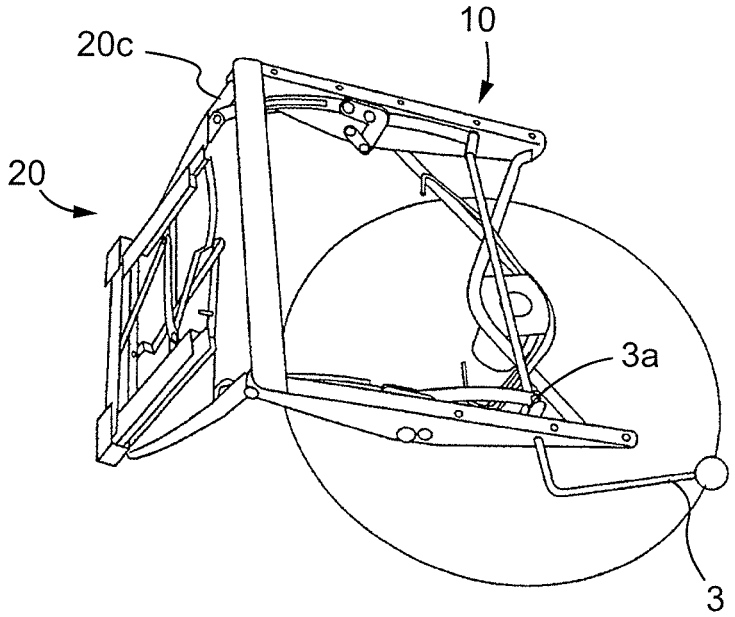
Figure 6:
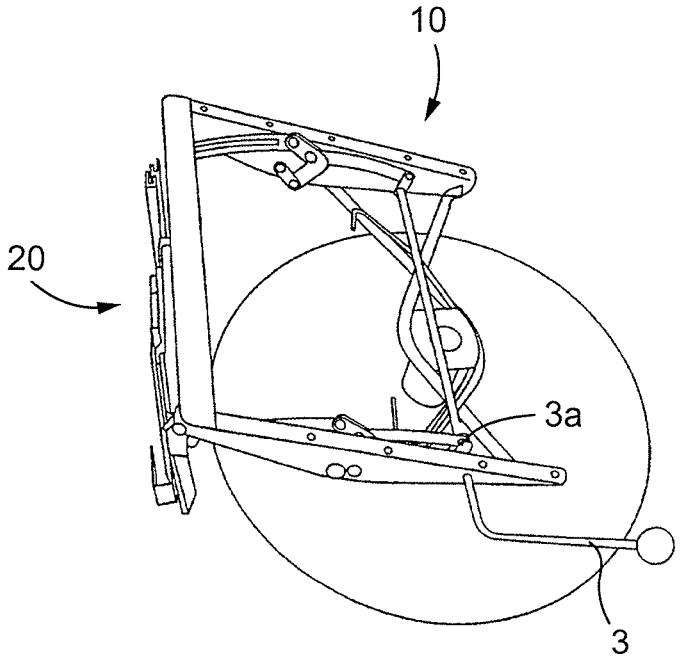
Figure 7:
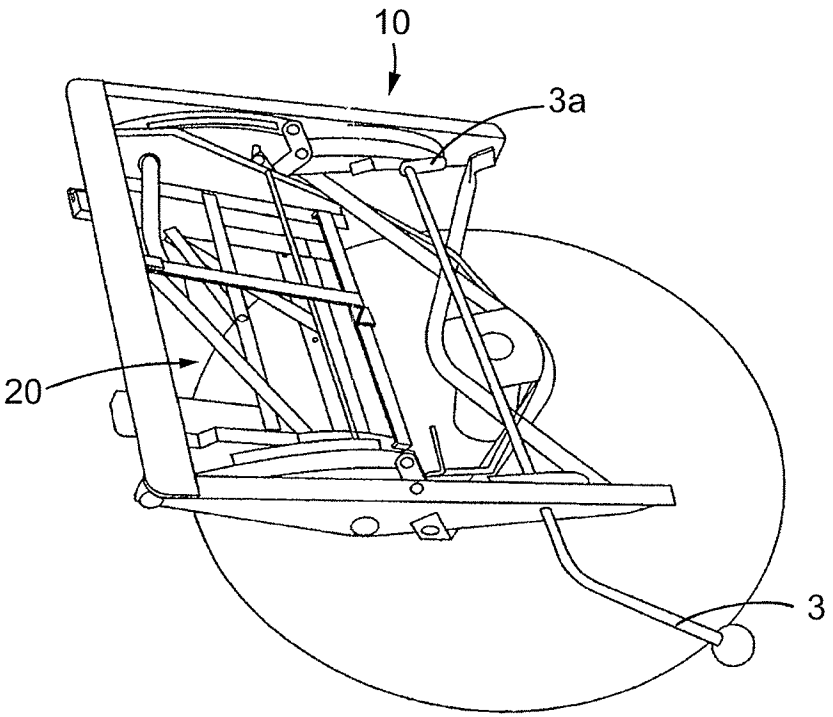
FIG. 7 depicts another perspective view of the improved leg and foot support to be applied to reclining armchairs, shown in its fully retracted position, and connected to a support base.

The improved leg and foot support structure applied to reclining armchairs, according to the present invention, is realized in structures defined in FIGS. 1 and 2., wherein a second inner sliding frame 20*b* is slidably assembled on the sliding frame 20*a* of the conventionally known leg and foot support structure as defined in FIGS. 1 and 2. Said second sliding frame 20*b* being provided with a front crossbar 23, and said second sliding frame moving parallel to the mentioned sliding frame 20*a*, thus defining an improved leg and foot support structure due to its capacity of extending the length of the leg and foot support.

According to FIGS. 3 to 7, the sliding frames 20*a* and 20*b* are shown in various positions of the leg and foot support structure during the rotation of the leg and foot support structure, from the fully retracted position to the fully extended position. During the movement, the articulated rigid frame 20*c* rotates, and the 20*a* frame slides along it, driven by arm 1. While the new frame 20*b* slides simultaneously on top of the sliding 20*a* frame, driven by arm 2.

The frames 20*a* and 20*b* only start their relative slippage when the articulated rigid frame 20*c*, during its rotation, reaches the vertical position. Thus, a bigger extension of the feet support is obtained with the help of the new 20*b* frame. The 20*b* frame slides on a duplicated rail which replaces the 20*a* single rail, and houses a system of articulated arms 2 that provides the extended length of the leg and foot support. See FIGS. 7, 6, 5, 4, and 3, in this sequence.

With this construction, a reduction of the height of the seat may be attained without hampering the final length of the support whenever it is extended.

FIGS. 3 to 7 also depict the driving mechanism driven by handle 3. Said handle 3 also allows to change the armchair's seat angle, not illustrated, upon the movement of the leg and foot support from the retracted to the fully extended position. It is comprised by two small pivoting arms which are connected to the armchair seat at its rear, and to the foot support system 20*a* and 20*b* and arm 3*a*. When handle 3 is rotated to extend the leg and foot support, its arm 3*a* rotates downwards, thus bringing the rear of the seat downwards also. The purpose of this device is to provide the option of a more inclinated seating position when the leg and foot support are activated and the armchair is fully reclined.

Figure 8:
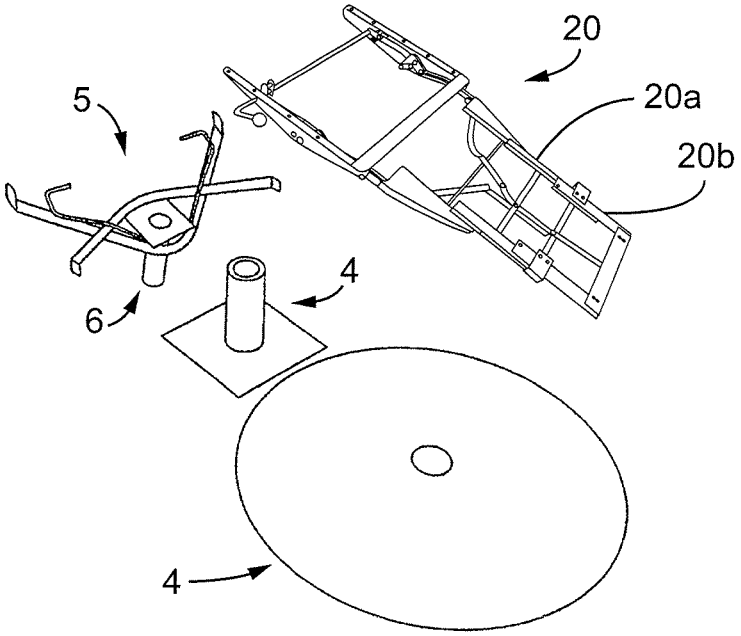
FIG. 8 depicts a view wherein the improved leg and foot support structures are shown aside of base components, illustrating the possibility of using different support bases.
Figure 9:
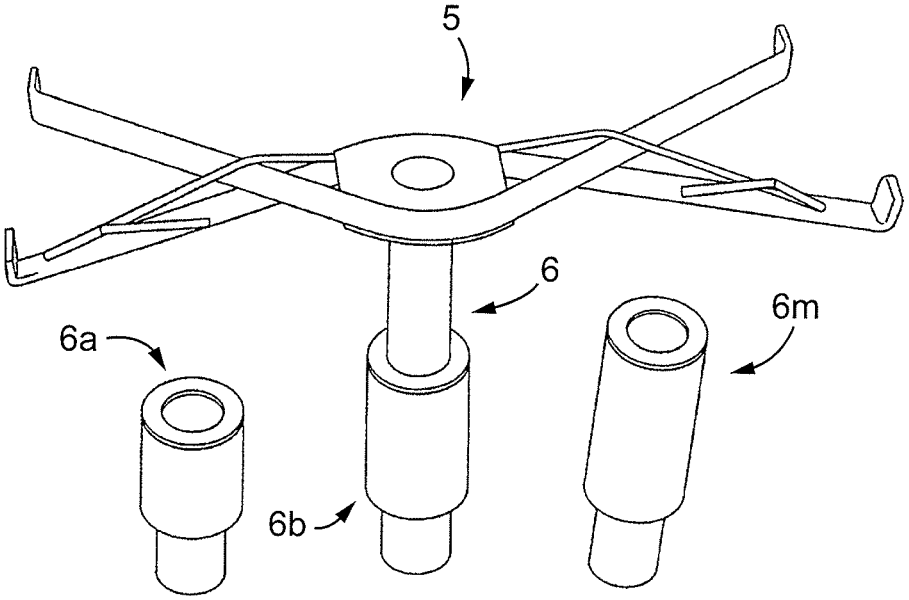
FIG. 9 depicts an enlarged perspective view of the base support structure, showing the possibility of using columns of different heights
Figure 10:
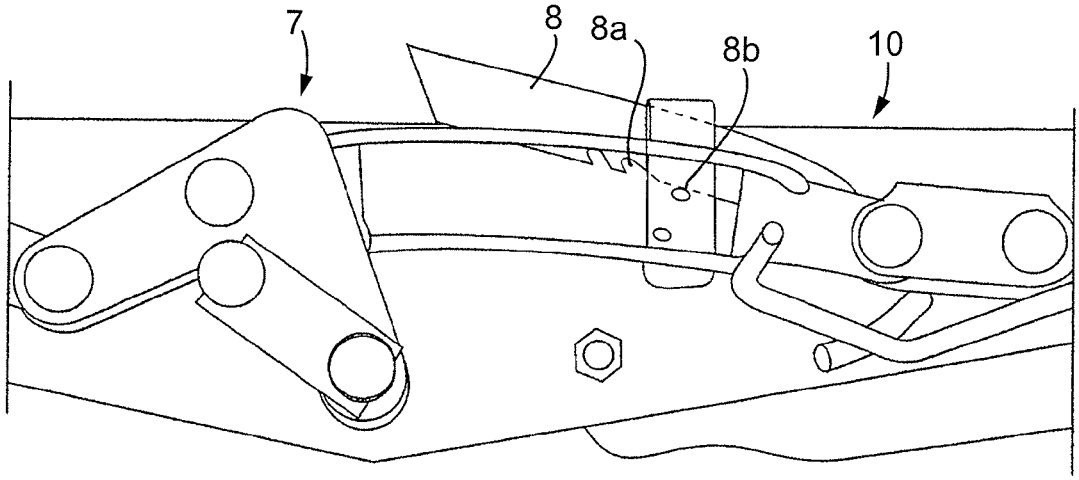
FIGS. 10, 11, 12, 13, and 14, depicts enlarged detailed views of the pivoting system and locking rod that, when assembled to the leg and foot support structure, acts in conjunction to the said leg and foot support structure to allow different positions for the height of the latest in relation to the floor.
Figure 11:
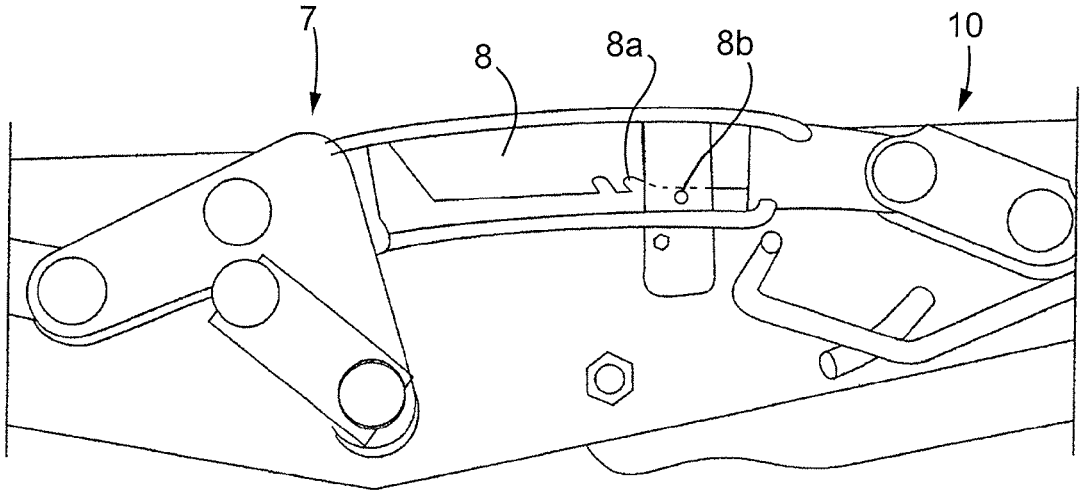
Figure 12:
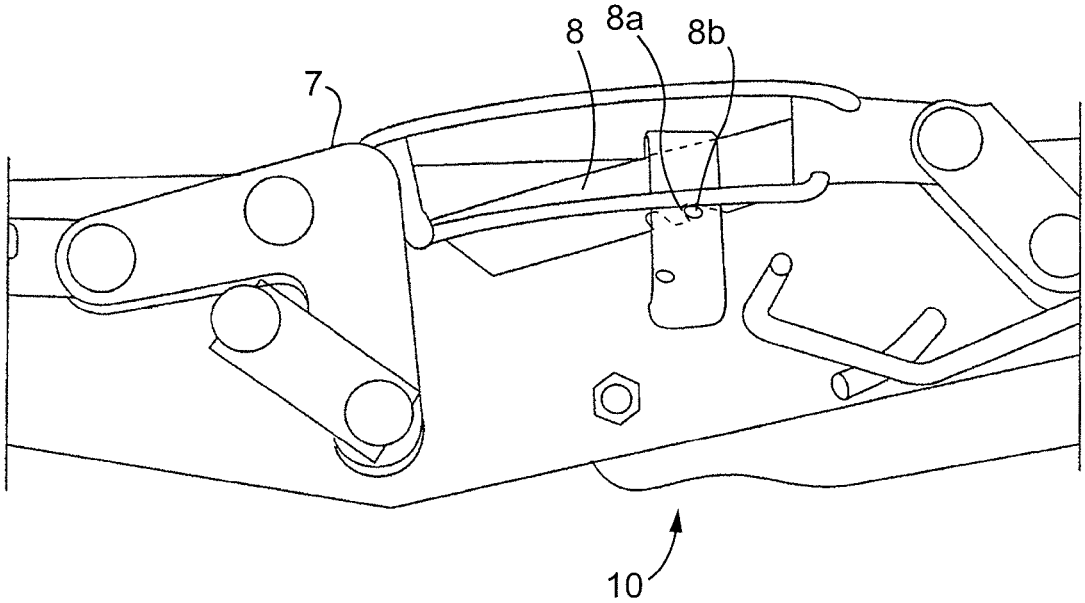
Figure 13:
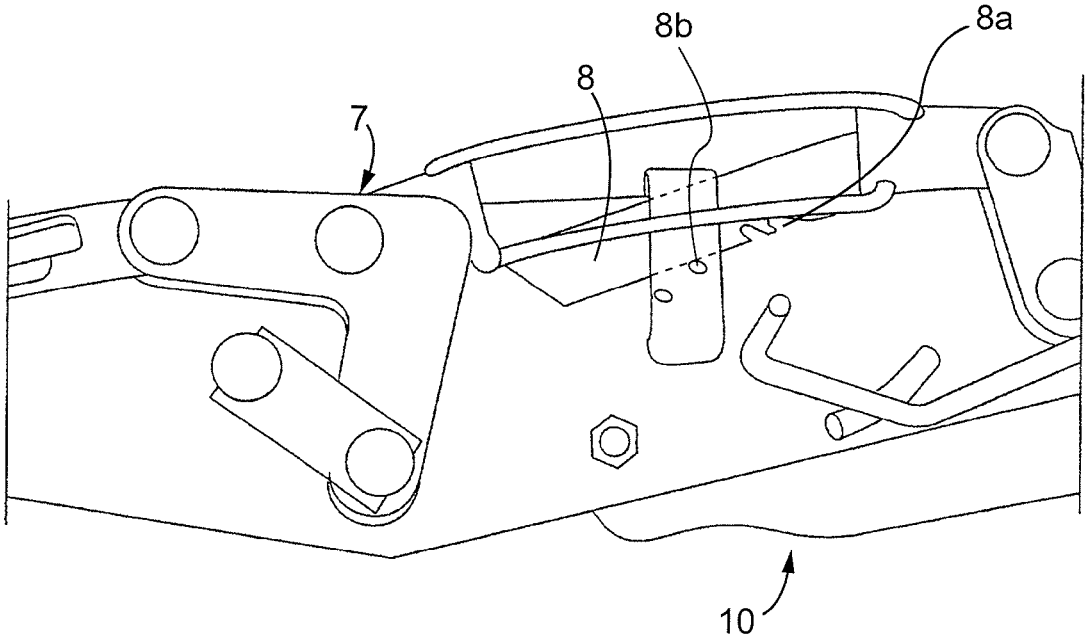
Figure 14:
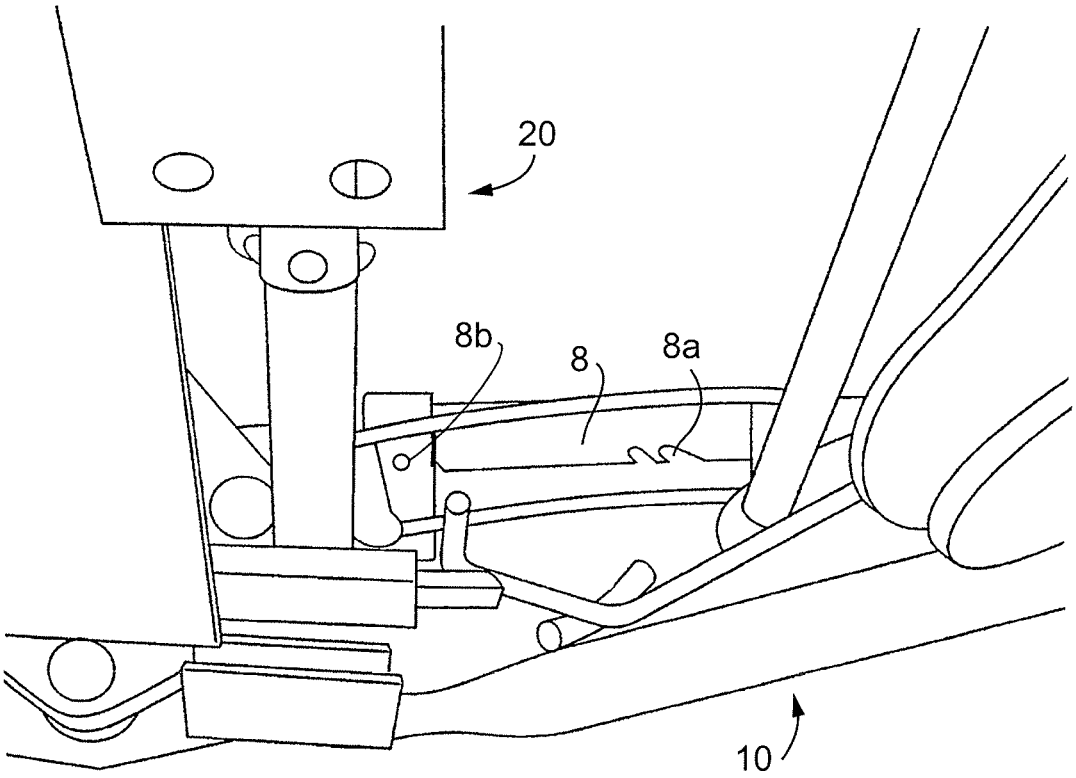
Figure 15:
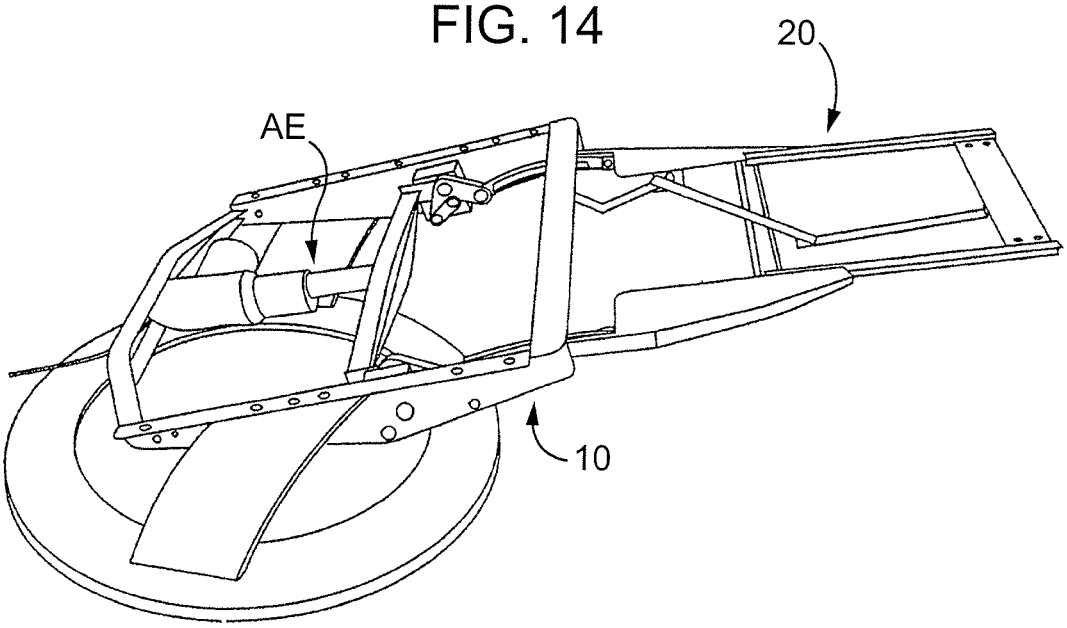
FIGS. 15, 16, 17, 18, and 19, depicts enlarged detailed views of the electrically actuated driving mechanism of the improved leg and foot support, shown in various positions to illustrate the constriction phases of the leg and foot support structure.
Figure 16:
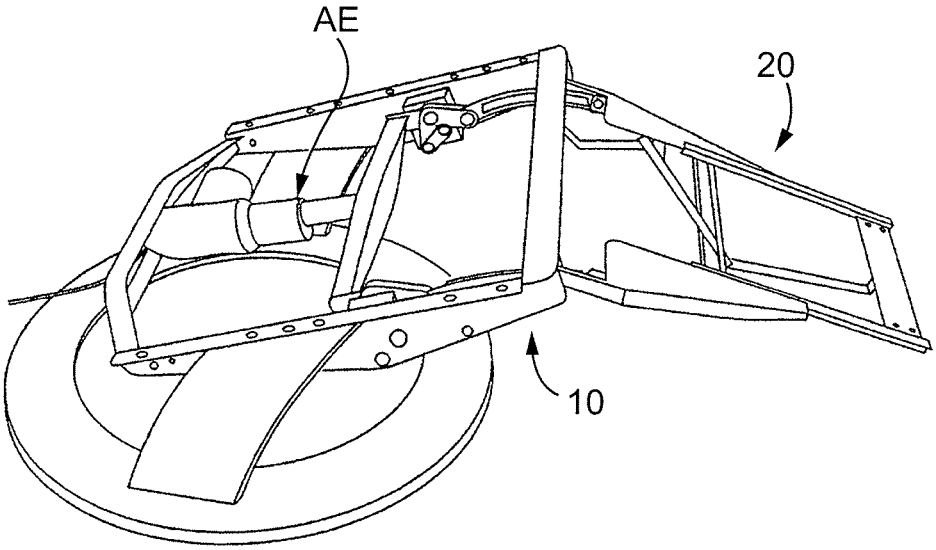
Figure 17:
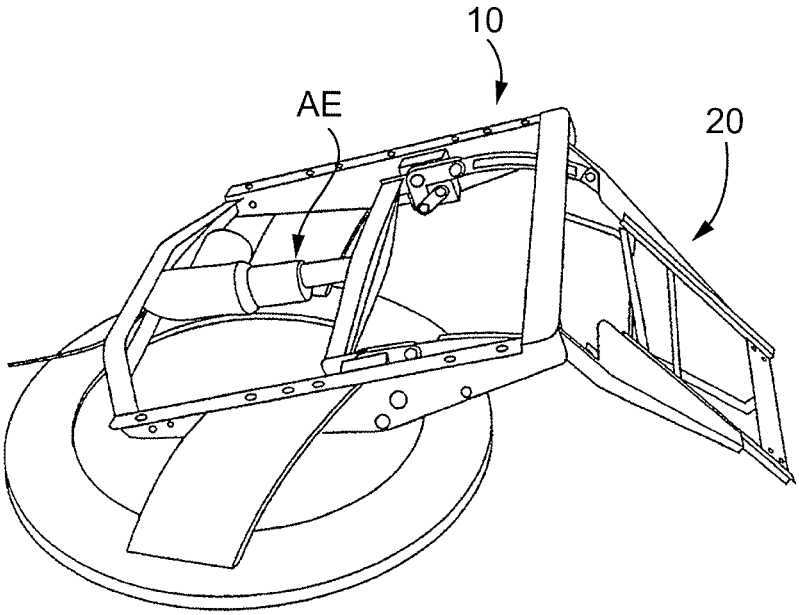
Figure 18:
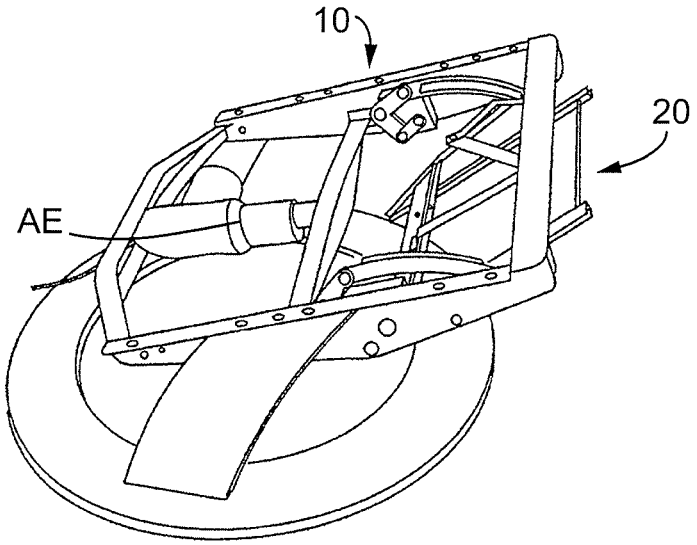
Figure 19:
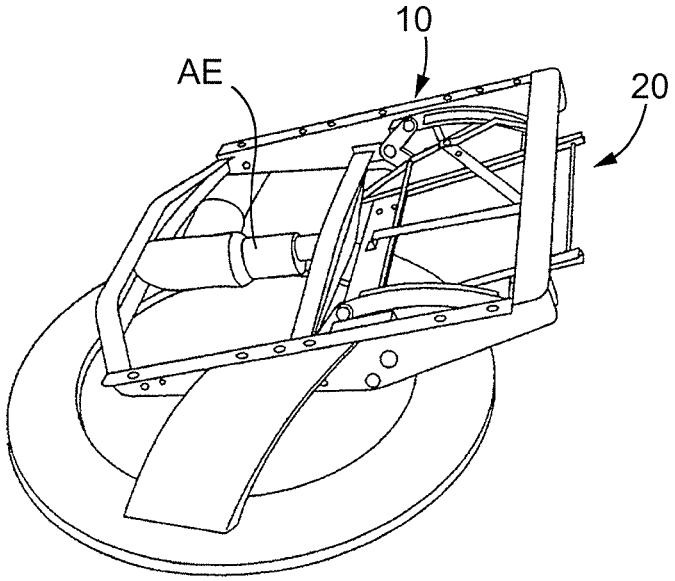

FIGS. 8 and 9 show that the frame 20, actuated by either electric actuators or a handle, may be assembled to any type of support base 4.

This is attained with a sub structure 5, that carries orthogonally a central axle 6 on the bottom thereof, which can be connected to different types of support bases, 4 being just an example, using coupling columns of different heights, 6*a*, 6*b*, . . . 6*n*, according to the desired seat height. To achieve different seat heights with just one coupling column, the system also provides the use of a coupling column with a spindle, or a gas cylinder.

FIGS. 10, 11, 12, 13, and 14, depict enlarged detailed views of pivoted system 7 and locking rod 8 that, when assembled to the frame 10 act in conjunction with the improved leg and foot support to selectively select the height of said leg and foot support in relation to the floor. Various heights can be selected, through this new system, this being performed by a locking rod 8, which operates in conjunction with a pin 8*b* when the leg and foot support is driven from its retracted to its extended position. The locking rod 8 is provided with various notches 8*a*, which operate with pin 8*b*. The notches are designed in an angle to operate with the pin 8*b* to allow, the user to select the position of his/her preference. To turn the leg and foot support back to the initial position, said locking rod 8 is displaced upward by a spring, not illustrated, when the locking rod 8 is about to reach its final position. This elevated position of locking rod 8 is kept until the leg and foot support is fully retracted.

Finally, FIGS. 15 through 19 show an alternative way of manually driving the leg and foot support, with the help of an electric actuator AE. Its stroke is determined to provide the same displacement as compared to the manual system. One of the main advantages of such electric powered actuator is the fact that it provides an unlimited number of height positions for the leg and foot support.

The invention claimed is:

1. A support structure applied to a reclining armchair for supporting legs and feet of a user, comprising:

a quadrangular rigid basic structure having sides and a crosspiece, the crosspiece being connected to an end of each of the sides, said quadrangular rigid basic structure being lifted by a support base that provides a spacing between ground and a seat frame;

a pivotable quadrangular articulated frame for supporting the user's feet, the pivotable quadrangular articulated frame being assembled to said rigid basic structure;

a driving assembly comprising articulated arms connected and actuated simultaneously by a driving unit;

the quadrangular rigid basic structure being defined by two quadrangular structures that slide over each other via the articulated arms, the articulated arms being pivotally connected to the two quadrangular structures and to the pivotable quadrangular articulated frame, the pivotable quadrangular articulated frame being angularly moveable to a position underneath the seat frame;

wherein said two quadrangular structures are configured to begin to linearly slide over each other only after the pivotable quadrangular articulated frame reaches an end of its angular movement.

2. The support structure according to claim 1, wherein the quadrangular structures comprise two rails, wherein one of the two rails houses the articulated arms that actuate a first one of the quadrangular structures to extend beyond a second one of the quadrangular structures.

3. The support structure according to claim 1, wherein the driving assembly is configured to enable a change in the angle of the seat frame of the armchair, when the armchair turns from an initial position to a reclined position.

4. The support structure according to claim 3, wherein the driving assembly comprises a handle connected to the seat of the armchair, and interconnected to the quadrangular structures through a pivoting arm connected to the handle, and when the handle is rotated it extends a first one of the quadrangular structures beyond a second one of the quadrangular structures, and the pivoting arm rotates in conjunction therewith, thus lowering the seat.

5. The support structure according to claim 1, wherein the quadrangular structures are actuated by the driving assembly, the driving assembly comprising actuators or handles which may be assembled on the seat frame, by a substructure connected to sides of the quadrangular structures that carries orthogonally a central column on a bottom thereof.

6. The support according to claim 5, wherein the central column is selected from a group consisting of a plurality of columns of different sizes to adjust a height of the seat.

7. The support structure according to claim 1, further comprising a locking rod mounted on a seat frame of the armchair and operatively coupled with the quadrangular rigid basic structure and the pivotable quadrangular articulated frame, said locking rod having several notches that operate in such a way that when an actuating lever of the driving assembly is rotated, one of the notches selectively engages a fixed pin, thereby allowing an operator to select a height of the armchair by selectively engaging the fixed pin.

8. The support structure according to claim 1, wherein the driving assembly comprises an electric actuator for adjusting the height of the quadrangular structures.

* * * * *